United States Patent [19]

Sweetman

[11] 4,395,887

[45] Aug. 2, 1983

[54] DEFROST CONTROL SYSTEM

[75] Inventor: James D. Sweetman, Manitowoc, Wis.

[73] Assignee: AMF Incorporated, White Plains, N.Y.

[21] Appl. No.: 330,525

[22] Filed: Dec. 14, 1981

[51] Int. Cl.[3] ..... F25D 21/06

[52] U.S. Cl. ..... 62/155; 62/176 A; 62/234

[58] Field of Search ..... 62/128, 140, 151, 155, 62/156, 176 R, 176 A, 176 E, 234; 73/335, 337, 336.5

[56] References Cited

U.S. PATENT DOCUMENTS 3,523,244 8/1970 Goodman et al. ..... 73/336.5
4,206,612 6/1980 Gardner ..... 62/128
4,209,994 6/1980 Mueller et al. ..... 62/155
4,251,999 2/1981 Tanaka ..... 62/176 A

*Primary Examiner*—Albert J. Makay
*Assistant Examiner*—Harry Tanner
*Attorney, Agent, or Firm*—David E. Dougherty; Charles J. Worth

[57] ABSTRACT

A defrost control system is provided for initiating one or more (defrost) timing cycles each at a different time and for terminating the cycles at the end of their respective predetermined (defrost) periods. The unit generally includes a solid-state, microprocessor based, programmable twenty-four hour timer, and a display panel. The system also includes a proportional defrost module which measures the absolute humidity of the atmosphere and adjusts the defrost initiate time(s) in accordance therewith.

12 Claims, 11 Drawing Figures

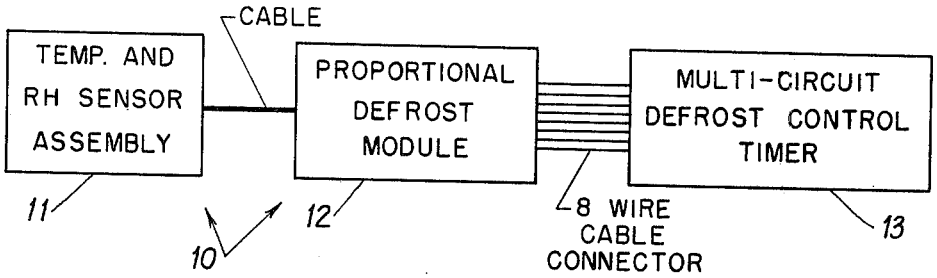
FIG. 1
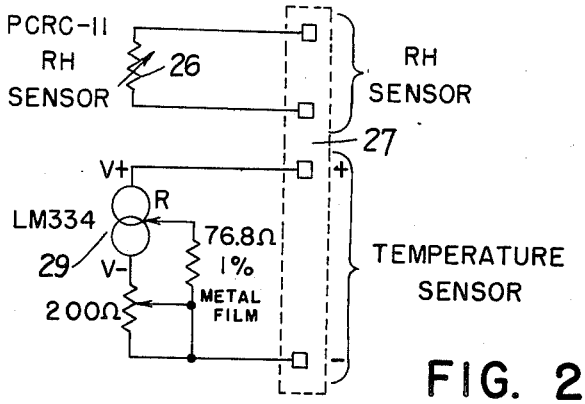
FIG. 2
| TEMPERATURE | 20% | 30% | 40% | 50% | 60% | 70% | 80% |
|---|---|---|---|---|---|---|---|
| 46° | 6.1 Hz | 9.2 | 12.3 | 15.3 | 18.4 | 21.5 | 24.5 |
| 53° | 8.0 | 12.0 | 16.0 | 20.0 | 24.0 | 28.0 | 32.0 |
| 60° | 10.4 | 15.6 | 20.8 | 26.0 | 31.2 | 36.4 | 41.6 |
| 67° | 13.3 | 20.0 | 26.7 | 33.3 | 40.0 | 46.7 | 53.3 |
| 74° | 16.9 | 25.4 | 33.9 | 42.3 | 50.8 | 59.3 | 67.7 |
| 81° | 21.6 | 32.4 | 43.2 | 54.0 | 64.8 | 75.6 | 86.4 |
| 88° | 27.6 | 41.4 | 55.2 | 69.0 | 82.8 | 96.6 | 110.4 |
20 Hz
60 Hz
RELATIVE HUMIDITY
FIG. 5
OUTPUT AS A FUNCTION OF TEMPERATURE (°F) AND RELATIVE HUMIDITY.

DEFROST CONTROL SYSTEM

BACKGROUND OF THE INVENTION

This invention relates to defrost controls for one or a plurality of referigeration units and, more particularly, to a demand defrost control system which monitors absolute humidity and adjusts the defrost initiate time accordingly.

DESCRIPTION OF THE PRIOR ART

It is generally recognized that an accumulation of frost on the coils of a refrigerating system is detrimental to the efficient operation and this is particularly significant in large commercial applications where economy of operation is of major importance.

Defrost controllers for one or a plurality of refrigeration units are known in the art for defrosting at regular timed intervals.

Heretofore, defrost control devices have controlled the defrost initiate times as a fixed time parameter or as a function of relative humidity.

For example, in one prior art device such as described in U.S. Pat. No. 3,945,217 issued Mar. 23, 1976 to Bashark, a refrigeration system includes a defrost control which includes a thermal relay, a bimetallic thermostat, and an element responsive to cumulative humidity of the refrigerated air. The humidity sensing element absorbs water vapor at a rate proportional to the relative humidity and activates a defrost heater element to initiate a defrost period with accumulation of a predetermined amount of moisture.

Another prior art device of interest is disclosed in U.S. Pat. No. 3,854,915 issued Dec. 17, 1974, to Schulze-Berge et al. The Schulze-Berge device comprises a demand defrost system which is responsive to the relative humidity values ambient to one or more refrigeration units.

A major problem encountered in the prior art defrost controllers is that relative humidity is temperature dependent.

PRIOR ART STATEMENT

The following patents represent some of the prior art pertinent to the field of demand defrost systems and defrost timers for refrigeration units: U.S. Pat. Nos. 3,460,352 issued Apr. 12, 1969 to Lorenz; 3,759,049 issued Sept. 18, 1973 to Bell et al; 3,913,344 issued Oct. 21, 1975 to Holloway et al; 3,939,666 issued Feb. 24, 1976 to Bashark; 2,687,620 issued Aug. 31, 1954 to R. G. Raney; 2,614,395 issued Oct. 21, 1952 to H. S. King; 3,759,049 issued Sept. 18, 1973 to C. A. Bell; 3,830,993 issued Aug. 20, 1974 to K. J. Schulze-Berge; 3,854,915 issued Dec. 17, 1974 to K. J. Schulze-Berge et al; 4,056,948 issued Nov. 8, 1977 to C. J. Goodhouse; 4,251,988 issued Feb. 24, 1981 to J. J. Allard and R. A. Heinzen; 3,903,515 to Haydon et al; 4,515,723 to Gardner; 4,001,557 to Stephenson; 4,152,902 to Lush; 4,200,910 to Hall and 4,209,994 to Mueller et al.

The above noted patents are mentioned as being representative of the prior art and other pertinent references may exist. None of the above noted patents are deemed to affect the patent-ability of the present claimed invention.

In contrast to the prior art devices, the present invention provides a defrost control system which controls-/adjusts the defrost initiate cyclicity-time in relation to the absolute humidity.

SUMMARY OF THE INVENTION

The present invention comprehends a defrost control wherein the initiation of the defrost cycle is controlled by means responsive to the absolute humidity conditions of the ambient air and/or within the refrigerator. Thus, the present invention comprehends the use of a control signal corresponding or relating to absolute humidity.

Theory of Operation

In the prior art systems as noted above, the defrost initiate times were determined by relative humidity. Relative humidity related defrost initiate was satisfactory if the store temperature remained constant. However, if the store temperature changes, as is now common with night setback of temperature to conserve energy, the prior art relative humidity responsive systems quickly lose their effectiveness. For example, assume that a store with a daytime ambient temperature of 70 degrees Fahrenheit has a relative humidity of 20%. The absolute humidity of this store would be approximately 22 grains of moisture per pound of dry air. If the store's ambient temperature is setback to 40 degrees Fahrenheit at night, the relative (ambient air) humidity would rise to approximately 61%. Thus, the prior (relative humidity responsive) systems may be ineffective or improperly function with temperature variation.

To obviate the above noted problem, the present invention comprehends a system for responding to absolute humidity, which is substantially independent of temperature.

The defrost control of the present invention is contingent upon the provision of a signal which is generally indicative of the absolute humidity, for example, of the ambient air in a store containing one or more refrigeration units.

The control signal is coupled to, for example, a solid state defrost timer and effects adjustment to the scheduled defrost initiate time, whereby the defrost cycle is initiated at a time moderated in response to a monitored absolute humidity condition.

One embodiment of the present invention contemplates a control signal with a frequency proportional to absolute humidity. The variable frequency control signal is coupled to the clock input of a defrost control unit which is set to initiate a defrost cycle at a selected time. With variation of the control signal frequence in proportion with variation in absolute humidity, the clock (rate of the defrost control unit is varied, for example, speeded-up or slowed-down, to effect an offset to the actual time at which the set (defrost initiate) time is sensed by the defrost control unit. Thus, the actual defrost initiate time is varied with a change in the monitored absolute humidity.

The frequency of the control signal is determined in accordance with the following relationship:

$$\text{OUTPUT FREQUENCY (Hz)} \times \tfrac{2}{3} \times \text{ABSOLUTE HUMIDITY (Grains)}$$

with the output signal selected to have a frequency between 20 and 60 hertz and a 50% duty cycle, when the system is energized by a 60 hertz power source.

A technique was discovered to monitor changes in the absolute humidity within the store. This technique recognizes the interrelationship between staturation humidity (which is a function of temperature), relative humidity and absolute humidity. The absolute humidity factor is determined, with measurement of the temperature and relative humidity, according to the relationship:

$$\text{RELATIVE HUMIDITY} = \frac{\text{ABSOLUTE HUMIDITY}}{\text{SATURATION HUMIDITY}}$$

OBJECTIVES OF THE INVENTION

Accordingly, an object of the invention is to provide a new and improved defrost timer.

Another object of the invention is to provide a generally solid state defrost timer for defrost sequencing a plurality of commercial refrigeration units.

A further object of the invention is to provide a new and novel defrost control system having a defrost initiate time adjusted or variable with variation in absolute humidity.

Yet another object of the invention is to provide an automatic programmable defrost timer system having means for altering the defrost initiate time in proportion to a determined variation in the absolute humidity of the ambient air within a monitored area.

BRIEF DESCRIPTION OF THE DRAWINGS

Other objects and advantages of the invention may be more clearly seen when viewed in conjunction with the accompanying drawings.

FIG. 1 is a block diagram of the defrost control system in accordance with the present invention;

FIG. 2 is a circuit diagram of the humidity and temperature sensor assembly shown in FIG. 1;

FIG. 5 is a relative humidity, temperature and frequency matrix chart;

DESCRIPTION OF A PREFERRED EMBODIMENT

Figure 3:
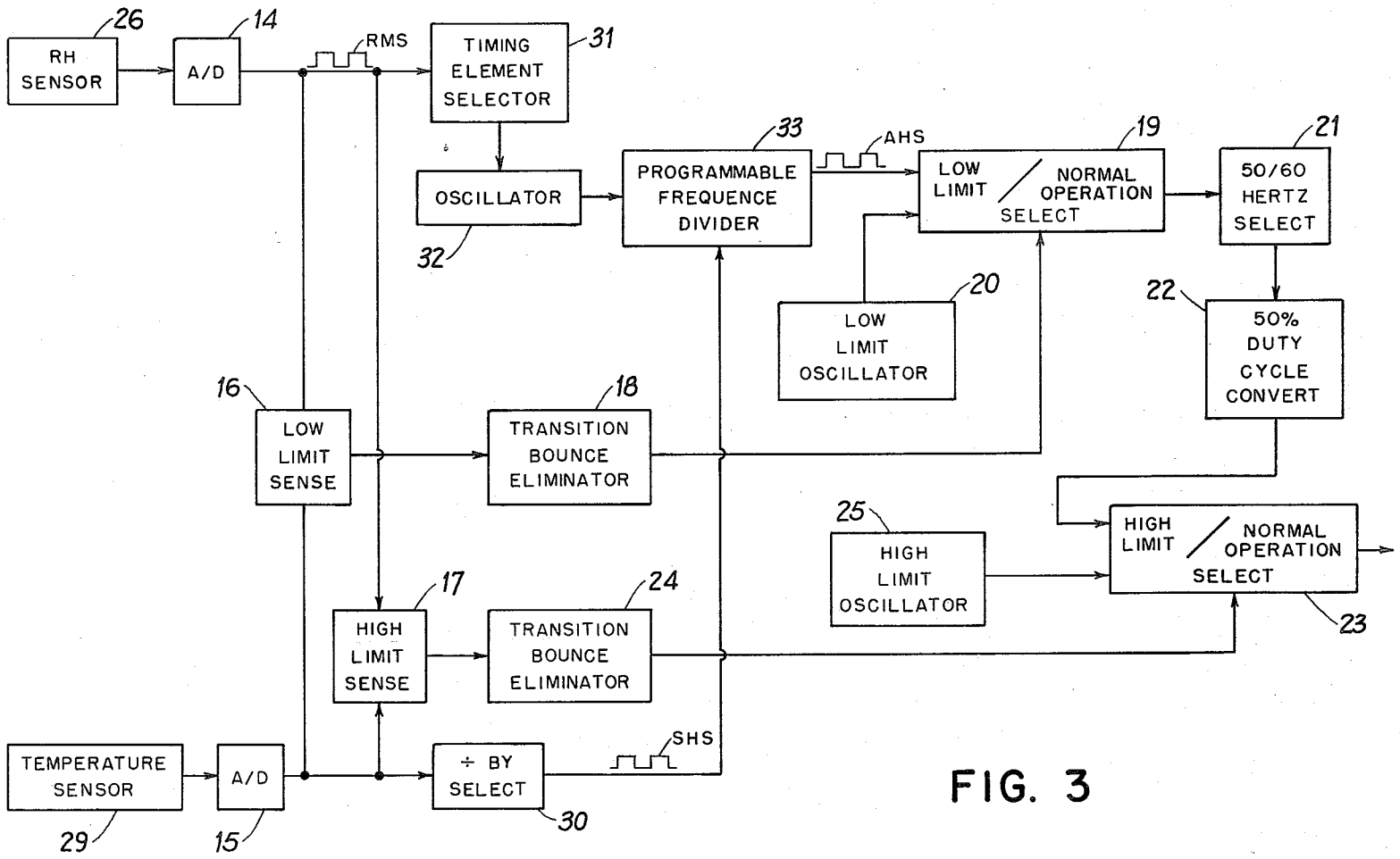
FIG. 3 is a block diagram of the circuit details of the proportional defrost module shown in FIG. 1.

With reference to the drawings, the preferred embodiment of the present invention will now be described in detail.

The defrost control system 10 generally comprises a temperature and humidity sensor assembly 11, a proportional defrsot module 12 and a defrost control timer 13 (see FIG. 1).

The defrost control timer 13, which will be described in greater detail hereinafter, generally includes a solid-state microprocessor based, programmable twenty-four hour timer for initiating one or more defrost periods having a predetermined defrost duration. The microprocessor's defrost initiate timing function is generally controlled by an input clock signal CL. In accordance with the invention, the frequency or rate of the clock signal CL is varied with a determined or detected change in the absolute humidity.

For example, if the timer 13 is programmed to initiate a defrost cycle at a selected time with a prevailing relatively high humidity condition being detected, the input clock signal CL will have a 60 hertz fixed frequency which causes the defrost timer 13 to generally be in synchronism with the displayed time or actual/real running time. However, if the absolute humidity condition is below a predetermined level, the input clock signal CL frequency is proportionally reduced to retard or slow the timing (processing) rate of the microprocessor such that the defrost initiate cycle is correspondingly delayed or postponed.

Accordingly, the function of the proportional defrost module 12 is to provide an input clock signal CL having a frequency or pulse rate which is varied in proportion with changes in the ambient absolute humidity within a monitored space. An absolute humidity signal or scaling factor is derived by the proportional defrost module 12 from the temperature and relative humidity signal information provided by the sensor assemlby 11.

With particular reference now to FIGS. 1, 3, 5 and 8, the circuit (logic) functions of the proportional defrost module 12 will be described.

As mentioned above, programmable timer 13 is programmed by the user/operator, assuming a high frost causing ambient condition, to initiate a defrost cycle at a selected time corresponding to an actual (display) time or running time of the timer 13. If the anticipated high frost causing condition prevails, the timer 13 is caused to initiate the defrost cycle at the programmed time which directly corresponds to the display/actual time. This is effected by the provision of a fixed (high) frequency 60 hertz clock signal CL to the clock input of microprocessor U19 of the timer 13 (see FIG. 8). If the temperature/humidity conditions are such that a slower frosting-up condition prevails, the clock signal CL frequency is lowered to delay the time at which the defrost cycle is initiated. The lower clock signal frequency causes the microprocessor U19 timekeeping function to run slower to cause the scheduled/programmed defrost initiate time to occur at a later time of day than was programmed by the user. Thus, the displayed time 14 (see FIG. 6) and the timekeeping function of the microprocessor U19 are caused to become out of sychronism.

The proportional defrost module 12 alters the defrost initiate time by the provision of an output clock signal CL having a controllable frequency generally falling within three groups or ranges, i.e., a low fixed frequency of 20 hertz, an intermediate frequency having a range or spectrum between 20 and 59 hertz and, a high fixed frequency of 60 hertz. Thus, depending on the sensed temperature/humidity conditions, a low or high fixed frequency or an intermediate variable frequency clock signal is provided by the proportional defrost module 12 to timer 13.

The data corresponding to relative humidity and temperature are converted into coded digital signals by the analog-to-digital (A/D) converters 14 and 15, respectively. Each of these signals are coupled to the low limit sense circuit 16 and the high limit sense cicuit 17.

If the relative humidity and temperature being sensed are at predetermined low levels, for example, such as a temperature of 46 degrees Fahrenheit and a relative humidity (RH) of 20%, the low limit sense circuit 16 provides a control signal, via anti-bounce circuit 18, to cause the signal select circit 19 to select/enable the low limit oscillator 20 to provide a perdetermined low frequency, e.g., 200 hertz, to the input of the 50/60 hertz select circuit 21. Assuming the 60 hertz (source) select is utilized, select circuit 21 and the duty cycle convert circuit 22 devide the 200 hertz signal output of oscillator 20 to provide a square wave signal having a fixed 20 hertz frequency to the high limit/normal operation select circuit 23. This 20 hertz signal is then coupled to the clock input (pin 39) of microprocessor U19.

On the other hand, if the temperature/humidity conditions are at predetermined high levels, for example, such as a temperature of 88 degrees Fahrenheit (F) and an RH of 80%, the high limit sense circuit 17 provides a control signal, via anti-bounce circuit 24, to cause select circuit 23 to select/enable the high limit gate or oscillator circuit 25 to provide a predetermined high frequency, i.e., 60 hertz, to the clock input (pin 39) of microprocessor U19.

However, if the absolute humidity conditions vary over a predetermined range, the proportional defrost module 12 will provide a corresponding or proportionally varying clock signal frequency, for example, approximately between 20 and 59 hertz to the clock input of microprocessor U19. Examples of a band or spectrum of clock signal frequencies varied in proportion with change in a derived absolute humidity parameter are shown between the dashed lines in FIG. 5. The signal frequencies, e.g., 6.1 Hz and 110.4 Hz, on opposite corners of the depicted matrix frequency chart and disposed without the intermediate band of clock signal CL frequencies, illustrate the output frequency signals that may be provided at the output of module 12, via circuits 20, 32, 19, 21, 22 and 23, if the low and high limit circuits 16 and 17 were not utilized. Any temperature/humidity condition that may result in such a low or high frequency, e.g., 6.1 Hz or 110.4 Hz, causes the low and high limit circuits 16 and 17 to effect the provision of a fixed 20 Hz or 60 Hz clock signal output.

The absolute humidity is determined from the monitored relative humidity and temperature data.

The circuit devices for monitoring the relative humidity and temperature are shown in FIG. 2. The relative humidity (RH) is sensed by an RH sensor 26 which may comprise a PCRC-11 electrohumidity sensor available from Phys-Chemical Research Corp. located at 36 West 20th Street, New York, N.Y. The RH sensor 26 provides a signal (RHS) which is indicative of the monitored relative humidity, via connectors 27 and 28, to analog-to-digital converter (A/D) unit 14.

The temperature is sensed by sensor 29 which may comprise an LM334 device available from National Semiconductor. The 200 ohm trimmer pot is used to adjust the temperature sensor so as to provide a current, for example, of 984 micro amps through the sensor cable at a temperature of 77 degrees F. The temperature sensor 29 provides a signal which is indicative of the store's temperature, via connectors 27 and 28, to A/D converter 15.

The temperature data is digitized into an approximate saturation humidity indicative signal by A/D converter 15 and coder circuit 30. The saturation humidity signal (SHS) is derived, by digital scaling logic, from the temperature data to generally reflect their correlation such as indicated in standard psychrometric charts.

A/D converter 14 digitizes the RH data and couples the digitized RH signal to the input of timing unit 31. In response to the digital RH signal, timing unit 31 alters the oscillator 32 frequency. This RH influenced frequency signal is then provided to the input of programmable frequency divider 33.

The programmable frequency divider 33, in response to the RH representative variable frequency signal and the divide-by-N programming SHS signal, provides an output frequency signal which corresponds to or varies in proportion with variation in absolute humidity.

With the humidity/temperature condition being above the low limit sense unit 16 and below the high limit sense unit 17 trigger levels, the absolute humidity variable frequency signal (AHS) output is provided, through switch unit 19, frequency divider 21, wave shaper/divider 22 and switch 23, as the clock signal CL input to microprocessor U19.

Figure 4A:
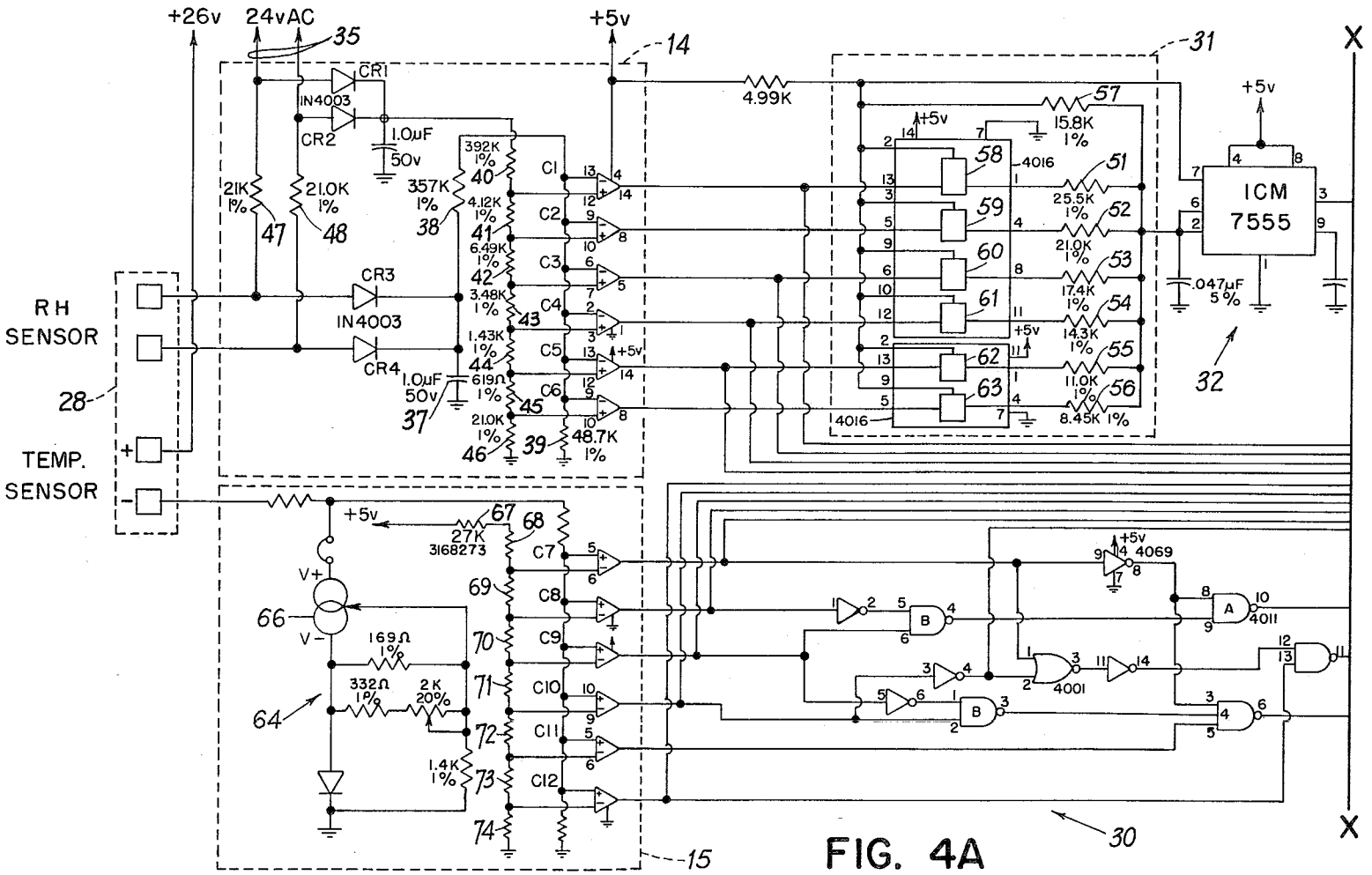
FIG. 4 is a circuit diagram of the proportional defrost control module.
Figure 4B:
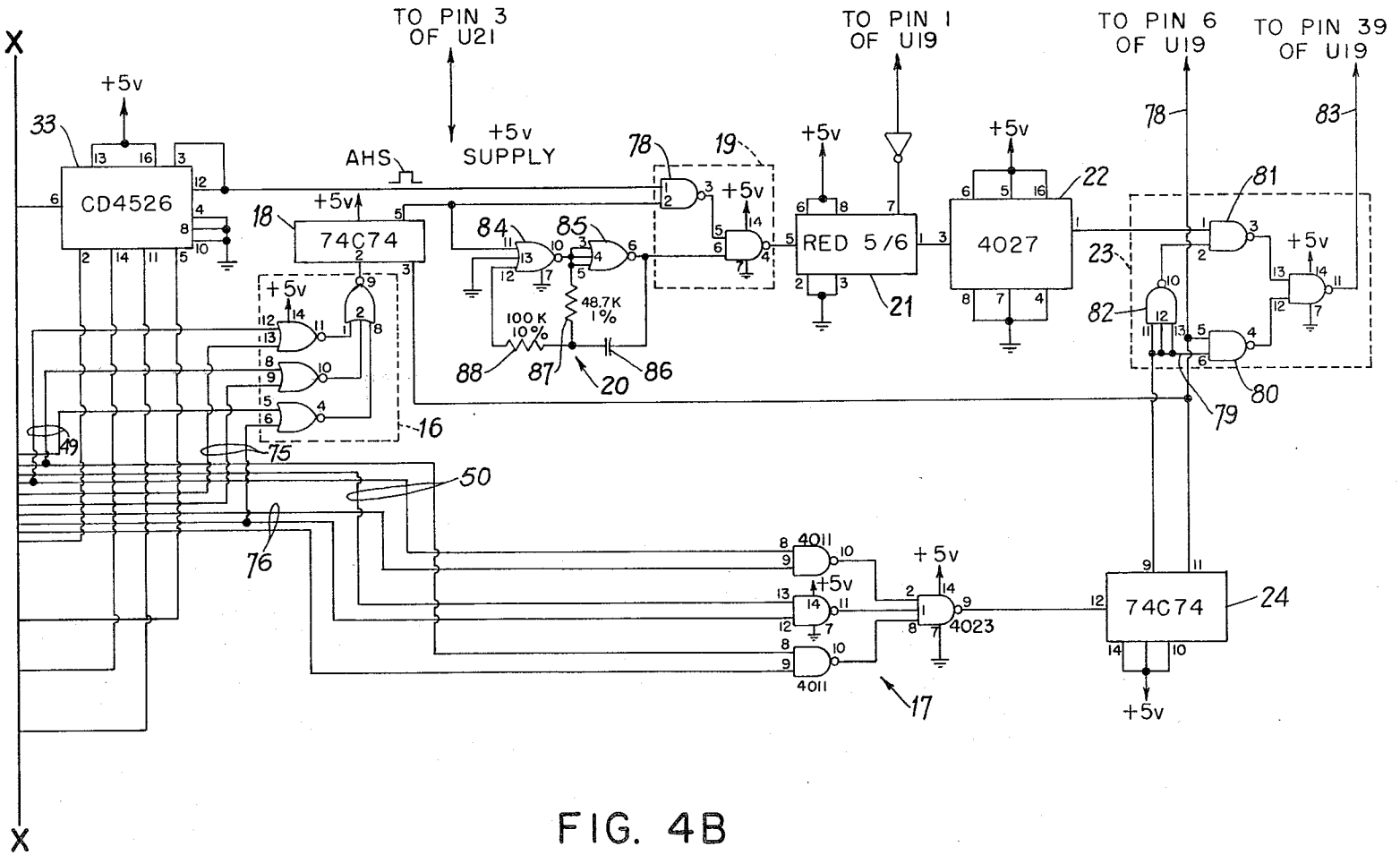

With particular reference now to FIG. 4, the circuit details of the proportional defrost module 12 will now be described.

The basic function of the A/D converter 14 is to convert the analog RH signal from the RH sensor 26, via terminal blocks 27 and 28, into a six bit digital signal output which is representative of the sensed relative humidity. A/D converter 14 is coupled to a power source, for example, the secondary of a 24 VAC transformer and a 5 VDC source within the defrost control timer 13, via leads 35 and 36 of an eight wire cable connector. Basically, the A/D converter 14 comprises six operational amplifiers (op-amps) C1–C6, such as an LM324 available from National Semiconductor, having their inverting inputs (indicated by a minus sign) connected to a voltage signal established by a biasing network including diodes CR3 and CR4, capacitor 37 and resistors 38, 47, 48, and 39 and RH sensor 26. The noninverting inputs (indicated by a positive sign) of op-amps C1–C6 are each connected to a respective reference voltage gradient formed by a series resistor chain or ladder 40–46 coupled between ground and the reference voltage. Each output of the op-amps C1–C6 comprises one bit of a six bit digital RH signal output of the A/D converter 14. The digital RH signal output is coupled to timing element selector 31, with three of its six bit coded signals also being coupled to the low limit sense unit 16, via cable 49, and three of its six bit coded signal outputs being coupled to the high limit sense unit 17, via cable 50.

The timing element selector 31 basically comprises six resistors 51–56 each of which may be selectively connected in parallel across resistor 57 by a respective digital switch or gate 58–63, in response to the coded signal from A/D converter 14. For example, with a logic high on the output of op-amp C1, switch 58 is closed to connect resistor 51 in parallel across resistor 53. In this manner, the RC timing network across pins 7 and 6/8 of oscillator 32 is varied to selectively control/vary its output frequency with variation in the relative humidity being monitored. The digital switches 58-63 may be of conventional design such as quad belateral switches CD4016M/CD4016C available from National Semiconductor.

To facilitate understanding, Table 1 below lists the truth table or six digit code output of the A/D converter 14 corresponding to selected relative humidity conditions.

TABLE 1

| RH | CL | C2 | C3 | C4 | C5 | C6 |
|---|---|---|---|---|---|---|
| 25% | L | L | L | L | L | L |
| 25–35% | H | L | L | L | L | L |
| 35–45% | H | H | L | L | L | L |
| 45–55% | H | H | H | L | L | L |
| 55–65% | H | H | H | H | L | L |
| 65–75% | H | H | H | H | H | L |
| 75% | H | H | H | H | H | H |

Oscillator 32 basically comprises an oscillator circuit or timer chip, for example, on ICM 7555 CMOS general purpose timer available from Intersil. As noted above, the frequency of oscillator 32 is variable in response to variation of the RC time constant present on its control inputs. The output variable frequency signal, which varies in response to the RHS, is coupled to the input of programmable frequency divider 33.

A/D converter 15 converts the analog temperature signal from sensor 29, via terminal blocks 27 and 28, into a six bit digital signal output which is representative of the monitored temperature. The A/D converter 15 comprises six operational amplifiers (op-amps) C7–C12, and a compatibility or constant current biasing network 64 having an adjustable current source 66, such as an LM334 available from National Semiconductor with a trimmer pot adjusted to provide a predetermined bias current, which functions to render the temperature signal compatible with op-amps C7–C12. The voltage reference network 65 comprises a plurality of series connected resistors 67-74 which form a bias ladder to establish a plurality of voltage reference gradients on a respective inverting input of op-amps C7–C12. The noninverting inputs of op-amps C7–C12 are coupled to the temperature signal. Each output of op-amps C7–C12 comprises one bit of a six bit digital temperature signal output of the A/D converter 15. The six bit temperature signal is coupled to the input of coder 30. Coder 30 basically comprises logic gates for converting the six bit temperature signal into a four bit digital coded signal representative of the saturation humidity. Since the relationship between temperature and the saturation humidity, over the range of present concern, varies in a known generally linear manner, coder 30 is designed to provide digital scaling of the six bite temperature signal for deriving a digital saturation humidity signal (SHS) indicative of the saturation humidity. The SHS signal output of coder 30 is applied to the programmable divide-by-N input of divider 33. Three digital bit signals of A/D converter 15 are coupled to the low and high limit sense circuits 16 and 17, via cables 75 and 76, respectively.

To facilitate understanding, Table 2 below lists the truth table or six digit code outputs of A/D converter 15 corresponding to selected relative temperature conditions.

TABLE 2

| Temperature | | C7 | C8 | C9 | C10 | C11 | C12 |
|---|---|---|---|---|---|---|---|
| 49.5° | F | L | L | L | L | L | L |
| 49.5–56.5° | F | L | L | L | L | L | H |
| 56.5–63.5° | F | L | L | L | L | H | H |
| 63.5–70.5° | F | L | L | L | H | H | H |
| 70.5–77.5° | F | L | L | H | H | H | H |
| 77.5–84.5° | F | L | H | H | H | H | H |
| 84.5° | F | H | H | H | H | H | H |

The programmable frequency divider 33 may be of conventional design such as a CD4526 programmable divide-by-N 4-bit binary counter available from National Semiconductor. The variable frequency signal output of oscillator 32 is divided-by-N when N is a coded SHS digital number provided by coder 30. Thus, the output frequency of divider 33 is subject to the variable frequency (relative humidity dependent) signal output of oscillator 32 and the derived SHS digital N number. These two factors are utilized to obtain a variable frequency AHS signal at the output of divider 33.

The low limit sense circuit 16 comprises a group of three 2-input NOR gates each having a first input connected to an output of a respective op-amp C1, C3 and C5 and a second input connected to an output of a respective op-amp C8, C10 and C12; and a 3-input NOR gate having its inputs each connected to a respective one output of the 2-input NOR gates. The output of the 3-input NOR gate is connected to a bounce eliminator circuit 18. Operationally, when the output (pin 9) of the low limit sense circuit 16 is high, the output of oscillator 20 is maintained at a (logic) high state on an input of NAND gate 77. And with pin 2 of NAND gate 78 high, the absolute humidity proportional frequency signal (AHS) is coupled through switch 19 to the input of the 50/60 hertz select circuit 21. However, if the output frequency of programmable divider 33 is below the selected low limit, the output of the low limit sense circuit 16 is at a (logic) low level to cause the fixed frequency signal of oscillator 20 to be coupled to the input of circuit 21.

The high limit sense circuit 17 comprises a group of three 2-input NAND gates each having a first input connected to a respective output of op-amp C7, C8 and C9, and a second input connected to a respective output of op-amp C3, C4 and C5. The outputs of these NAND gates are are connected to a respective input of a 3-input NAND gate, whose output (pin 9) is connected to the bounce eliminator 24. If a predetermined (high) code is detected, the high limit sense circuit 17 will couple a 60 hertz clock signal from lead 78 through switch 23 to the clock input (pin 39) of microprocessor U19. When the duty cycle converter 22 output signal is below 60 hertz, the high limit sense circuit 17 will be activated, via leads 50 and 76, to provide a low signal level, via bounce circuit 24 and lead 79, to inhibit gate 80 to disconnect the 60 hertz frequency from the output of switch 23. A high (logic) level is presented at pin 2 of gate 81, via gate 82, to connect the variable clock signal output from the duty cycle converter 22 to the clock output of switch 23. When the output of the duty cycle converter 22 is above 60 Hertz, the high limit sense circuit 17 effects an inhibit signal to pin 2 of gate 81 and an enable (high) signal to pin 6 of gate 80 to connect a 60 hertz clock signal to the clock output 83 of switch 23.

The transition bounce eliminators 18 and 24 may be utilized to reduce or eliminate erratic switching by the limit sense circuits 16 and 17, respectively, due to any 60 hertz ripple in the output coded signals of the A/D converters. Each bounce eliminator circuit 18 and 24 consists of a D-type flip-flop having its clock input connected to a 60 hertz clock signal.

The low limit oscillator 20 may be of conventional design. The present configuration utilizes two series connected NOR gates 84 and 85 with feedback via capacitor 86 and resistors 87 and 88 to an input of each gate.

The 50/60 hertz select circuit 21 comprises a divider circuit capable of divide-by 5 or 6 operation. The divider 21 may be of conventional design such as the RED 5/6 available from LSI Computer Systems, Inc. During 60 hertz operation, the divider 21 effects a divide-by-5 operation to the ASA output signal of divider 33 or to the frequency signal output of oscillator 20. During 50 hertz operation, the divider 21 effects a divide-by-6 operation to these signals.

The 50% duty cycle convert circuit 22 divides the frequency of the output signal of the 50/60 hertz select circuit 21 by 2, i.e., in half, and also functions as a wave shaper to effect a 50% duty cycle on the divided frequency signal. The duty cycle circuit 22 may be of conventional design such as a CD 4027 J-K master/-slave flip-flop as available from National Semiconductor.

The high limit/normal operation select circuit 23 comprises a plurality of gates, for example, NAND gates, connected as a switch circuit for switching between the output of the duty cycle convert circuit 22 or the output of the high limit oscillator circuit 25/78, under a switch control signal from the high limit sense circuit 17.

The high limit oscillator circuit 25 may comprise a connecting lead 78 from a 60 hertz signal from the timer 13 or a separator 60 hertz signal generator.

With the defrost system being operated off a 60 hertz source, the output clock signal of switch 23 can vary over a frequency range of 20 to 60 hertz, depending on sensed humidity conditions. With the defrost system operated off a 50 hertz source, the output clock signal has a frequency range generally between 16.7 and 50 hertz.

Figure 6:
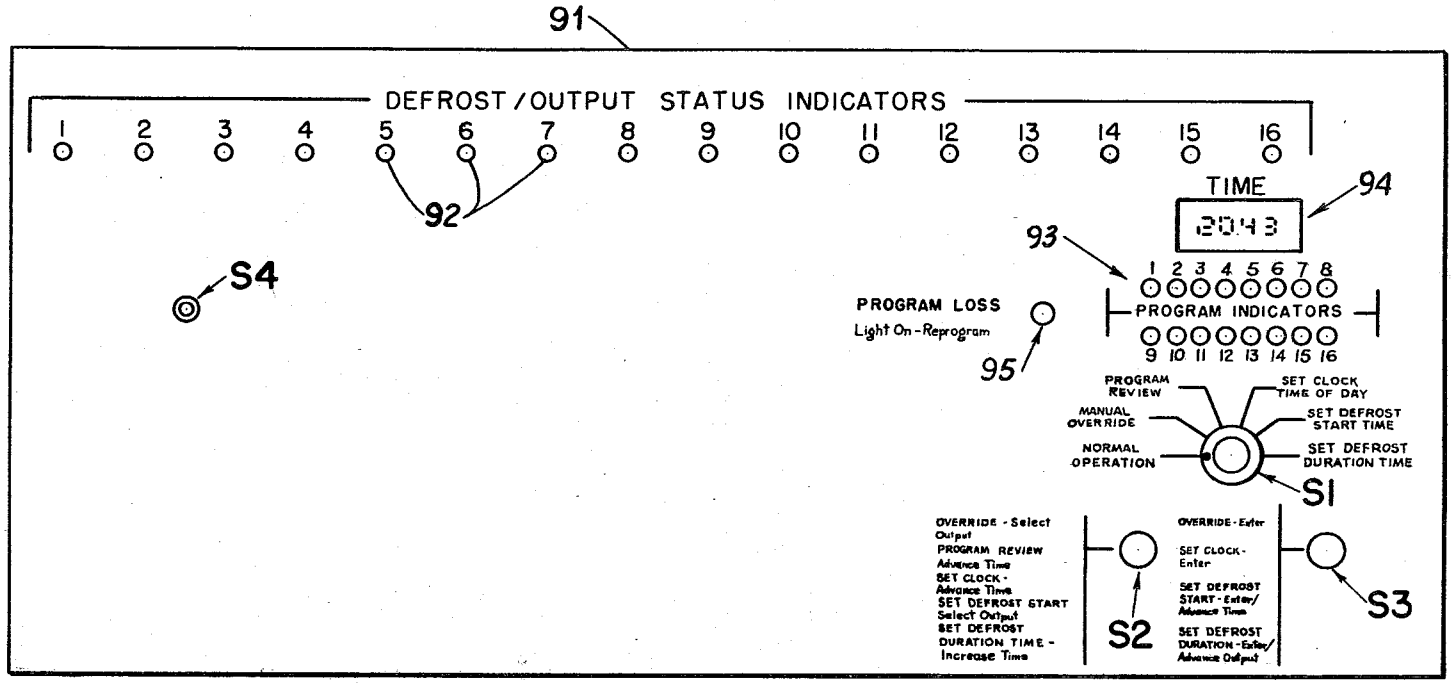
FIG. 6 is a perspective representation of the display panel for the defrost control system.
Figure 7:
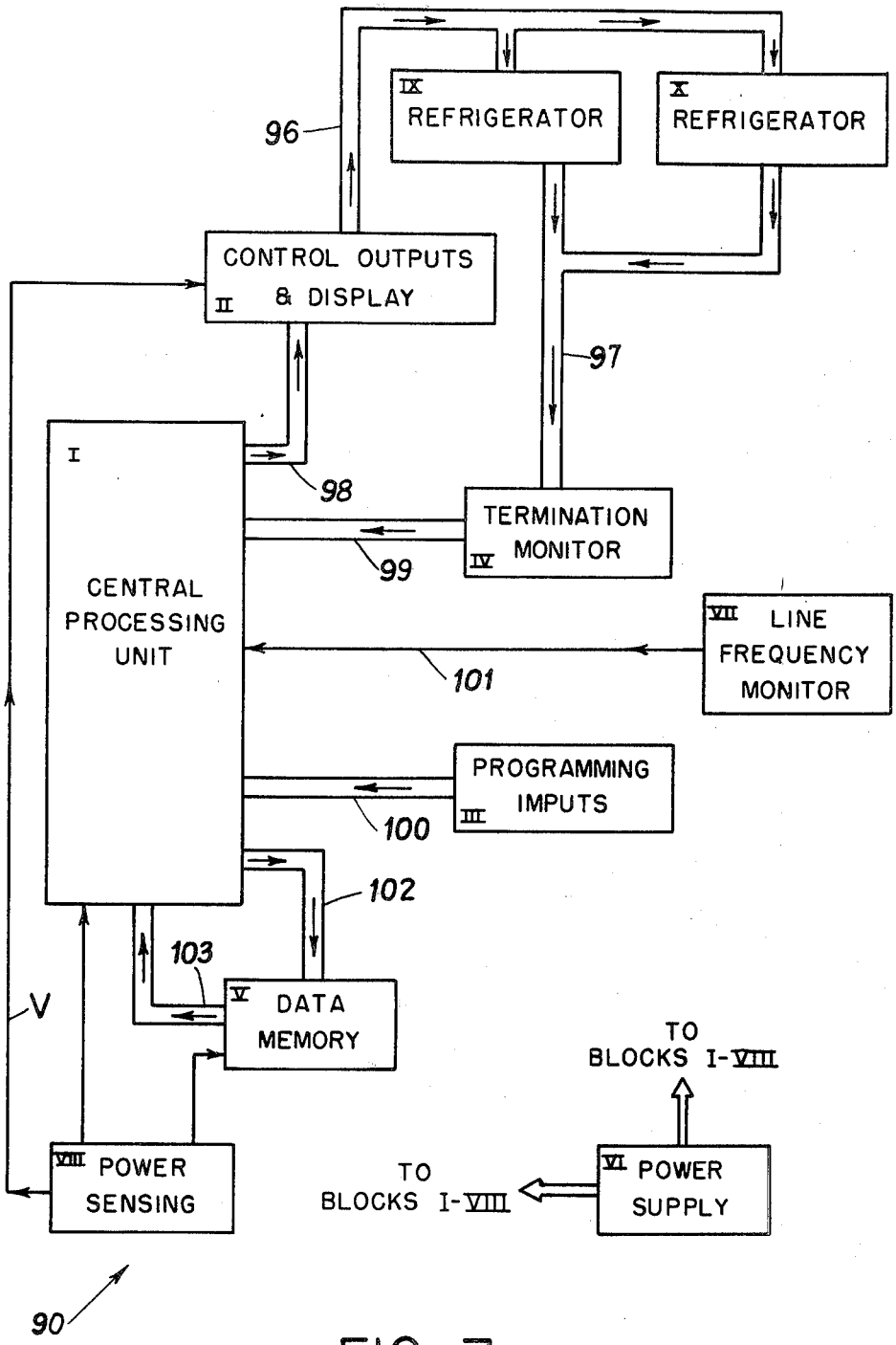
FIG. 7 is a general block diagram of the circuit logic employed in the multi-circuit defrost control unit.

With reference to FIGS. 6 and 7, the basic functions and features of the central defrost control timer 90 will now be described. The display panel 91 generally comprises a first set 92 of defrost/output status indicators, a second set 93 of program indicators, a solid state digital time reference display 94, a mode select switch S1, an advance switch S2, a data enter switch S3, a memory clear switch S4, and a program loss indicator alarm 95.

Each set of indicators 92 and 93 contains sixteen (16) separately energizable indicia, for example, lamp or light emitting diode (LED) devices. Each set 92, 93 of indicators is respectively numbered 1–16, with each correspondingly designated indicator, e.g., output/-status and program indicators designated number 1, being indicative of the program/status of a respective one of a possible sixteen (16) individually monitored/-defrost controlled refrigeration units, e.g., unit X.

The mode selector switch S1 comprises a multi-position rotary switch for selectively placing the central defrost control system 90 in one of six mode positions. The modes of operation indicated on the front panel 91 are: (1) Normal Operation, (2) Manual Override, (3) Program Review, (4) Set Clock Time Of Day, (5) Set Defrost Start Time, and (6) Set Defrost Duration Time.

The advance switch S2 comprises, for example, a pushbutton switch, which when actuated in cooperation with the mode selector switch S1 being in the manual override position will initiate a defrost cycle of the selected refrigeration unit. A printed list of the functions effected by the advance switch S2 corresponding to each mode selector switch S1 position is provided on the front panel 91.

The data enter switch S3 comprises, for example, a pushbutton switch, which when actuated with the mode selector switch S1 being properly mode selected, will enable data entry into the program of the selected-/addressed program corresponding to a respective refrigeration unit or to toggle the defrost control output state with the mode selector switch S1 in the Normal Override position. In tabular form juxtaposed to the data enter switch S3 is a printed listing of the functions effected by data enter switch S3 in cooperation with mode selector switch S1. The listed functional features of the data enter switch S3 are: Override-Enter; Set Clock-Enter; Set Defrost Start-Enter/Advance Time; Set Defrost Duration-Enter/Advance Output.

The time reference display 94 basically comprises a digital electrooptical display capable of displaying thereon unit minutes, tens of minutes, unit hours, tens of hours, and a decimal interposed between the tens of minutes digit and the unit hours digit. Each digit comprises, for example, seven discrete segments arranged in a figure eight pattern. Each of the seven segments is selectively actuated to form the numbers 0-9 for each of the digits. Driving circuitry suitable for actuation of digital display timepieces are known in the field, such as is described in U.S. Pat. No. 3,333,410 issued Aug. 1, 1967 to A. N. Barbella and U.S. Pat. No. 3,579,976 issued May 25, 1971 to T. F. D-Muhala.

An alarm indicator 95 is provided on the front panel 9 to visually display to the operator that a program loss has occurred and, therefore, reprogramming is required.

Another feature which is provided on the front panel 91 is a memory clear switch S4 to enable the operator to selectively clear the programmed memory. This switch S4 may comprise any conventional switch such as a pushbutton switch.

The control and feedback/monitoring features provided on the front panel 21 of the defrost control system 90 will now be discussed for each of the mode selector switch S1 positions.

With the mode selector switch S1 in the Normal Operation mode, the time reference display 94 is activated to illustrate the cycle reference time, for example, 20 hours and 43 minutes, of a predetermined time period such as a twenty-four hour day. A blinking or flashing decimal between the unit hours digit and tens of minutes digit is indicative of the Normal Operation mode. It should be recognized, that the actuation of switches S2 and S3 will have no effect with the mode selector switch S1 disposed to the Normal Operation mode position. While in the Normal Operation or run mode, the defrost control system 90 sequentially interrogates each of the refrigeration units IX, X associated program and, if program directed, provides a signal/circuit path to the respective refrigeration unit to initiate a (programmed) defrost cycle. As will be more fully discussed hereafter, the duration of the defrost cycle may be programmed controlled and/or constrained by a manual end defrost signal. During each defrost cycle, the respective defrost/output status indicator corresponding to the defrosting refrigeration unit will be energized to provide a visual indication that a defrost of that refrigeration unit is being conducted. A manual override initiated defrost cycle will be indicated by a blinking program indicator for the respective refrigeration unit being defrosted. While in the Normal Operation (run) mode, a blinking time reference display will indicate a power interruption.

With the mode selector switch S1 rotated to the Manual Override position, the time reference display 94 is frozen or held to depict the reference time when Manual Override was selected. The defrost/output status indicators 92 will display the programmed on/off defrost output status of control unit 90 for each respective refrigeration unit. The program indicators 93 are momentarily blanked and then output/program number 1 is addressed, turning on program indicator number 1, i.e., energizing to illuminance, to provide an indication as to which output is under manual control. Pressing the enter switch S3 while in the Manual Override mode will cause the output defrost control state indicated by the respective status indicator to toggle in its control state. For example, if status indicator number 1 and, therefore, defrost control output K1 (see FIG. 10) were off, i.e., not in a program control defrost cycle, pressing the enter switch S3 while in Manual Override mode will turn-on status indicator No. 1 and manually initiate a defrost cycle, to effect deforsting of the respective refrigeration unit. However, if the K1 output and status indicator No. 1 were on, i.e., in a programmed defrost status, they will turn-off with an actuation of the enter switch S3 while in the Manual Override mode to effect termination of the programmed defrosting of the respective refrigeration unit. It should be noted that manual initiation of a defrost cycle in this manner will effect a defrosting for a predetermined duration from the point in time at which the manual defrost override was actuated. Any occurrence of a programmed defrost initiate will be honored while in this mode if prior to selector switch S1 entry to the Manual Override mode the control unit 90 was not in one of the program modification modes, i.e., the Set Clock Time of Day mode, or the Set Defrost Time mode, or the Set Defrost Duration Time mode.

With the mode selector switch S1 now turned to the program review mode, the time reference display 94 and status indicators 94 will function in a similar manner as if the control unit 90 was in the Normal Operation mode except that the display decimal will be caused not to flicker. If the advance pushbutton switch S2 is held depressed, i.e., actuated, the time reference display will advance at a rate of 4 minutes per second. And each of the discrete program indicators 93 will be sequentially energized starting from the displayed reference time at which the program review advance pushbutton switch S2 was depressed by the operator. Also each correspondingly designated program indicator will coincidently turn on/off to indicate the future defrost time/-duration programmed event for the respective defrost control outputs. Thus, in this manner a review may be made to determine the output defrost overlap periods and the next scheduled defrost periods. Pressing the data enter switch S3 while in this mode has no effect and the occurrence of a programmed defrost initiation will be honored if prior to entry to this mode the control had not been in a program modification mode.

With the mode selector switch S1 turned to the Set Clock Time Of Day mode, the reference time being displayed by display 94 is held or frozen and the program indicators 93 are blanked out, i.e., deenergized. Momentarily pressing the advance (pushbutton) switch S2 will increment the time being displayed, and if held depressed will cause the display to ripple increment at a rate of 4 minutes per second. Upon incrementing from 59 minutes to 00 the minutes digits will be frozen at 00 and the hour digits will ripple increment of a rate of 2 hours per second. When the desired hours is reached the button is released. Depressing pushbutton switch S2 again will cause the minutes to again be incremented. Upon reaching the desired time reference, depressing the enter switch S3 will update the program controls to the time displayed, as well as clearing any memory failure or power interrupt indication. It should be noted, that a programmed defrost initiate will not be honored while in this mode.

With the mode selector switch S1 turned to the Set Defrost Start Time mode position, the displayed time reference will assume a 15 minute past present hour digit display with respect to the time base of the time keeping logic of timer unit 90. The status indicators 92 will indicate those outputs which were programmed on/off prior to entry into the Set Defrost Start Time mode. Pressing the advance pushbutton switch S2 will cause the program indicators 93, starting from the No. 1 indicator, and associated memory to be sequentially activated/addressed. Pressing the enter switch S3 with any program indicator selectively actuated will place into memory the time slot being displayed by display 94 at which the corresponding defrost control output is to be turned on, and erases any previously programmed defrost initiate for this time slot. Upon completion of this data entry, the time display will automatically increment to the next programmable time slot and the program indicators 93 will again indicate what if any output is programmed to initiate defrost at this time (initiate) slot. Pressing the enter switch 53 without making any modification will make no modification to the program but merely set the time display to the next programmable time slot.

With the mode selector switch S2 being turned to the Set Defrost Duration Time mode position, the program indicators 93 will be blanked momentarily and program indicator number 1 will be energized to indicate program modification acess. And time display 94 is actuated to present the program defrost duration in minutes. Pressing the advance button S2 will increment the displayed duration and if held will ripple advance the display at a rate of 4 minutes per second. The programmable range allowed for the duration is between 5 minutes and 180 minutes. Therefore, the decimal is blanked out with defrost duration programming so as to remove any confusion as to the units of measurement being displayed, i.e., minutes, on the time reference display 94. Depressing the enter button S3 will enter into the control memory that duration which is displayed for the indicated output, for example, output number K1, and automatically increment the output program indicators 93 to the next successive output. Pressing the enter button S3 without any modification to the programmed duration will merely increment the program indicators 93 and, therefore, the addressed program to the next successive output control without modification to that output previously interrogated.

It should now be recognized that only one output/refrigerating unit may be programmed to initiate a time defrost cycle during any given (15 minute) time slot. However, previously initiated defrost cycles may be in progress during the defrost initiate of other refrigeration units. Thus, a plurality of defrost output signals and, therefore, refrigeration units, may be concurrently in a defrost cycle.

In any selector switch S1 mode position, an output that is already in a defrost cycle will remain so, unless manual override is exercised, under its normal time out control. However, the occurrence of a program initiate defrost cycle will only be honored if during the programmed occurrence the unit was in a Normal Operation mode, a Manual Override mode, or a Progam Review mode, i.e., the system 20 was not in a program modification mode prior to entry into the Manual Override and Program Review modes. Also, at all times the control system 90 will respond to an external termination signal for any output that may at that time be in a defrost status.

The control system 90 will not retroactively respond to program events missed while the control unit 90 was in a program modification mode, but will follow future programmed events scheduled at a time following return of the control unit 90 to its Normal Operation mode.

A further feature which may be provided is a memory clear pushbutton switch S4. Pressing this button will erase all memory and produce a memory failure indication. This feature may be utilized to clear the system's memory for complete reprogramming necessitated, for example, where there was a prolonged power shortage and the integrity of the previously programmed defrost instructions is in question.

The overall operation and general organization of the timer 13 is illustrated by the block diagram depicted in FIG. 7.

The preferred embodiment of the defrost control timer 90 basically consists of: a central processing unit (CPU) or microprocessor device I, a control output and display device II, a programming input section III, a termination monitor IV, a data memory section V, a power supply VI, a line frequency monitor VII and a power sensing circuit VIII.

The operation of the system is under the control of the central processing unit (CPU) I which executes preprogrammed (loaded) instructions stored, for example, in memory unit V. The CPU I is connected to the functional blocks via command input and output (I/O) data buses. The defrost control system 90 transmits defrost control signals/circuits paths via data bus 96, and receives defrost status information from the refrigeration units, for example, IX and X, via data bus 97.

The CPU I is coupled to the control output and display unit II via data bus 98, terminator monitor unit IV via data bus 99, programming input unit III via data buss 100, line frequency monitor VII via lead 101 and, to the data memory section V via data buses 102 and 103. The power sensing circuit VIII and the power supply VI are both connected to the respective functional blocks noted above via connecting leads.

Figure 8:
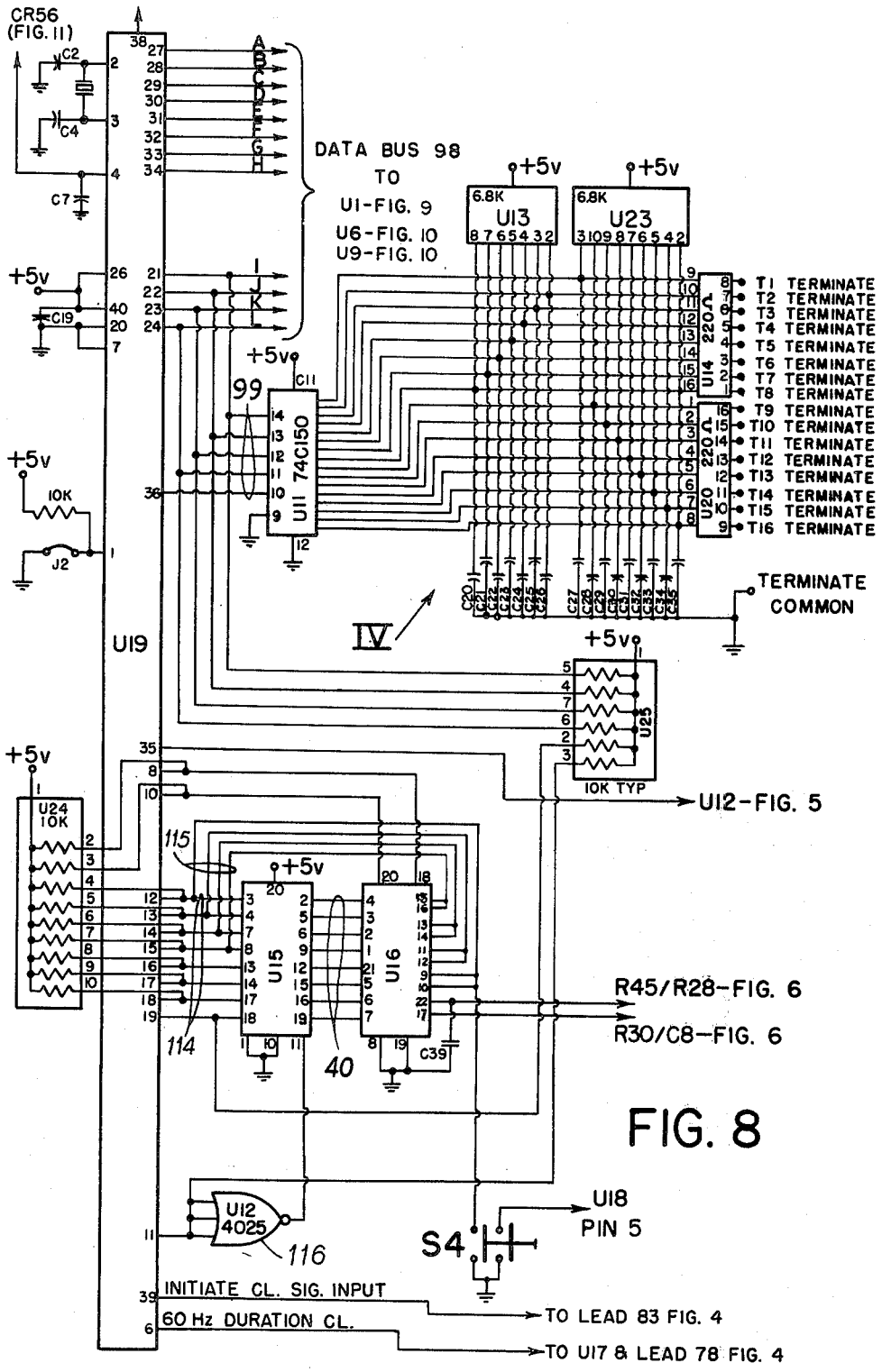
FIG. 8 is a circuit diagram of the central processing unit, memory and input monitoring logic.

With reference now to FIGS. 7 and 8, the CPU I basically comprises an 8-bit micro-computer or microprocessor U19 such as an 8048 Intel circuit chip having a mask programmed ROM, and which functions as the master controll for the system 90. Attached to the microprocessor U19 is a 3.579545 MHz oscillator Y1, whose function is to provide a stable frequency reference base for the microprocessor's U19 internal clocking oscillator. The two twenty-two Pfd capacitors C2 and C4, connected to this crystal, provide a phase shifting effect necessary for proper oscillator operation. The jumper J2 connected to the microprocessor U19 provides a means for controlling the microprocessor U19 operation for either a 50 hertz or 60 hertz line frequency. With the jumper J2 in the circuit, the system 20 operation is enabled for a 60 hertz input line current to power supply VI. With the jumper J2 removed, the system is enabled for a 50 hertz line current source. The resistant network U24 is used to pull-up specific I/O lines to the microprocessor U19 in order to both improve the rise time of signals presented thereon, as well as to improve the voltage level assumed by these lines when supplied a logic "1" level.

With reference to FIGS. 7–10, the control output and display unit II will now be described in more detail.

As noted above, CPU I control data is time-division multiplexed into this circuit configuration via data bus 98. Data bus 98 comprises 12 outputs from the microprocessor U19, eight of which A-H are connected to both the Octal bus driver and Octal "D" flip-flop circuits U6 and U1. The data transmitted via data bus 98 controls the state the defrost output signals/relays are at, and which segments of the digits in the time display 94 are to be activated and which program indicators are to be energized. Circuits leads I-L from pins 21–24, respectively, of microprocessor U19 supply a binary coded signal to the BCD-to-Decimal decoder U9 which may comprise a 4028B circuit chip from RCA. This decoder or demultiplexer U9 is used to provide a 1 of 8 selective strobe to correlate data being simultaneously provided on lines A-H originating from pins 27–34, respectively, of microprocessor U19. Decoder U9 provides a 1-of-8 selective strobe, via data bus 104, to the selector switch S1 and to a 6-Digit MOS-to-LED cathode driver U10, such as 75492 circuit chip by Texas Instruments.

The first four outputs of the MOS-to-Led drive circuit U10 are connected to the time reference display 94. The display 94 is, for example, a 4-digit LED numeric array, such as the NSA1541A by National Semiconductor. Each digit of this display 94 is connected as a common cathode, 7 segment array, and having a decimal point. The four strobed lines 110 from pins 1, 2, 6 and 7 of the MOS-to-LED driver U10 serve to selectively constrain which digit of the display 94 is activated by coincidence biasing with the information being presented on the 8 input lines via data bus 105, of the display. The other two strobe lines 106 and 107 from the output of the driver circuit U10 function as the cathode drive to the two banks of program (LED) indicators 108. Each bank of program indicators comprise 8 discrete LED's CR18–25, CR26–33.

A resistor network U8, containing 8 discrete resistors, functions as a current limitor to the 8 respective lines sourcing the individual LED's of both banks of program indicators 93, as well as functioning as a current limitor to the respective common segments of the 4 digits of the time reference display 94.

Figure 9:
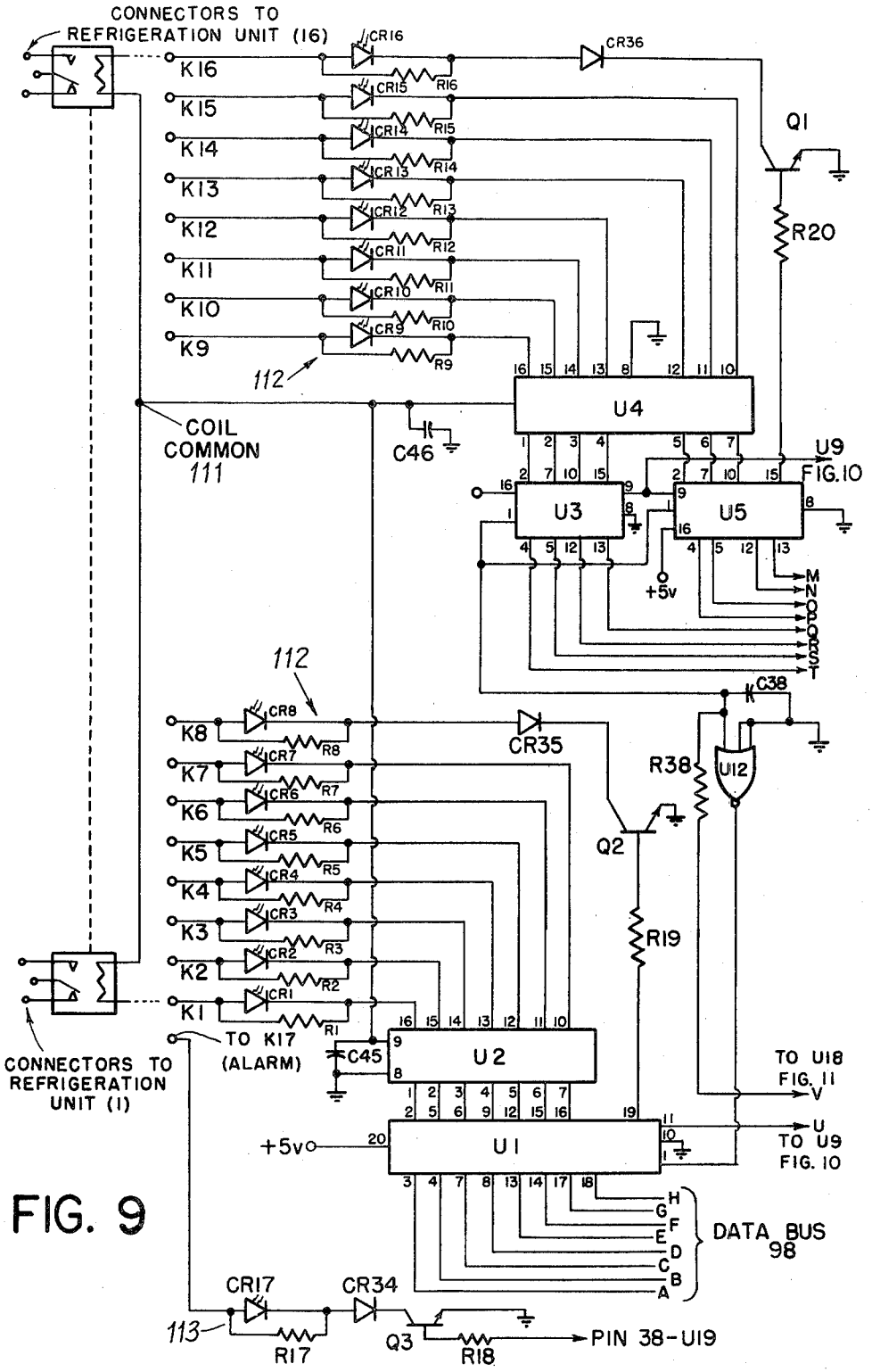
FIGS. 9 and 10 are circuit diagrams showing the defrost program/status control signals to the display panel and outputs for controlling the defrost cycles of the refrigeration units, and the program mode selector switch.
Figure 10:
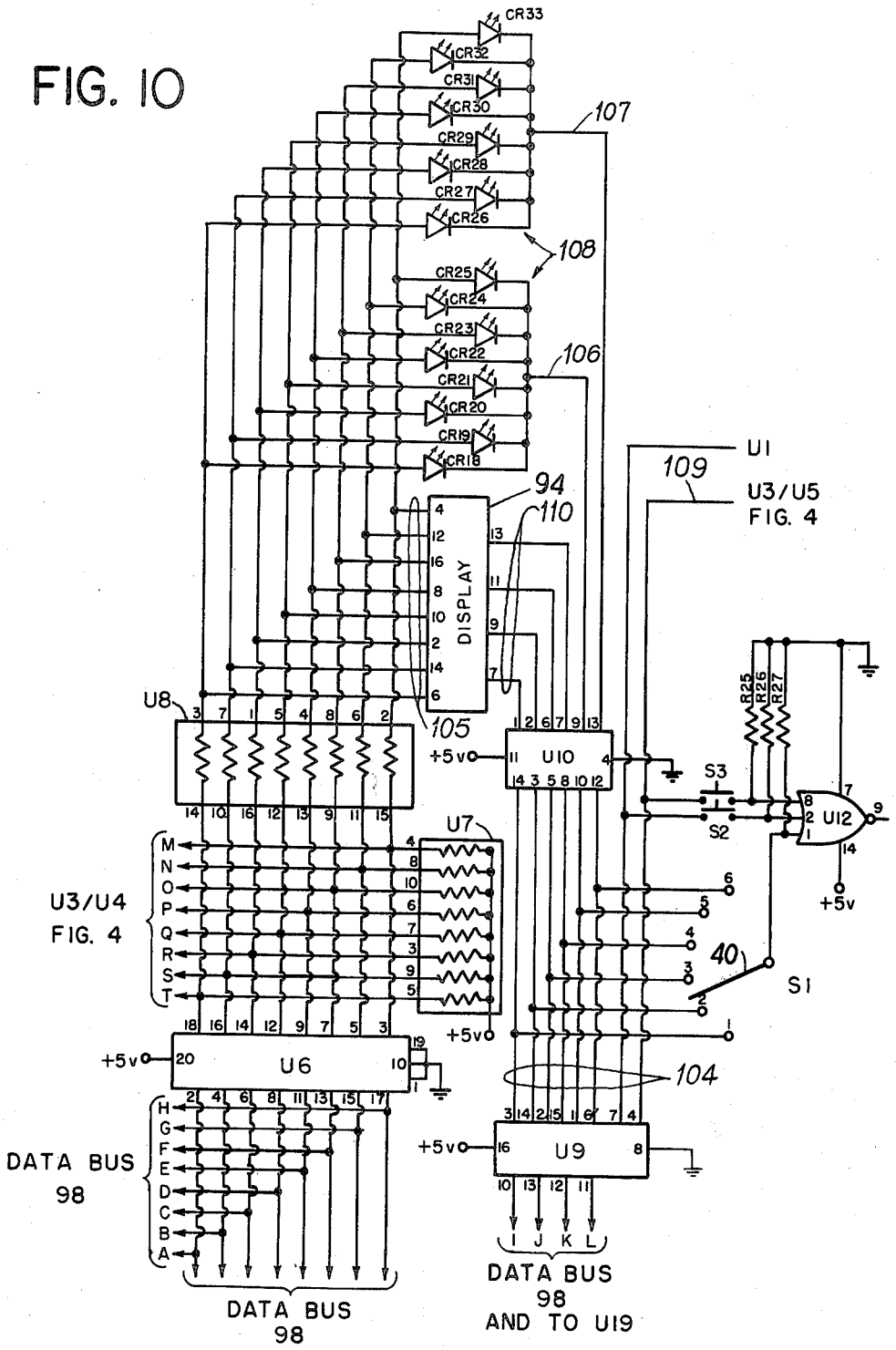

Sourcing resistor network U8 is an octal bus driver U6 such as a 74LS244 by Texas Instruments. The inputs of the Octal bus driver U6 are connected, via data bus 98, to respective outputs of micrprocessor U19. The octal bus driver U6 functions as a current booster for the signals from the microprocessor U19 to drive the display 24 and program (LED) indicators 93. The outputs from the octal bus driver U6 are individually connected to a pull-up resistor within resistor network U7 so as to improve the voltage level at the inputs to the two Quad "D" flip-flop networks Us and U5 (FIG. 9). The two Quad "D" flip-flop networks U3 and U5 function to latch this information for the purpose of controlling 8 of the 16 output defrost control signal outputs K9=K16, for example, to respective relays hereinafter discussed. These two flip-flop devices U3 and U5 have a common latch strobe, via lead 109, originating from multiplexer U9 (FIG. 10).

Output pins 2, 7, 10 and 15 of flip-flop network U3 and output pins 2, 7, 10 of flip-flop network U5 are connected to a high-voltage, high-current NPN Darlington transistor array U4, such as an MC1413 by Motorola. The Darlington transistor U4 functions as a 7 channel driver for the first 7 of the 8 outputs K9–K16. The last output pin 15 of flip-flop circuit U5 is fed into the base of an NPN transistor Q1 via a current limiting resistor R20. Transistor Q1 has its collector connected, via diode CR36, and status indicator number (CR) 16 to output K16. Transistor Q1 serves as the driver for output K16. When activated, these drivers selectively will provide a current path to ground, i.e., the relay coil common III, by which their respective outputs may be energized.

A (LED) defrost/status indicator CR9–CR16 is connected in series between an output driver and a defrost signal/relay drive output K9–K16, respectively. Each defrost/status indicator CR9–CR16 is, thereby, selectively energized to luminance whenever drive signal is provided to a defrost/signal (relay) output K9–K16, respectively.

A similar circuit configuration as described above is utilized to provide defrost signals on outputs K1–K8. However, in this circuit configuration on Octal "D" flip-flop network U1, in response to control signals from microprocessor U19, via data bus 98, is used to selectively control each of 8 driver connected in series with a defrost/status indicator CR1–CR8 and outputs K1–K8, respectively. Driver output circuit U2 comprises a Dalington transistor array containing 7 output drivers such as an MC1413 by Motorola. The driver to output K8 is formed by transistor Q2 in series with diode CR35.

The alarm indicator 95 is formed by a LED CR17 and is energized to luminance by driver Q3 in response to an alarm signal from microprocessor U19. The alarm signal is activated if the unit has suffered a user program memory loss resulting for example, from a power loss. The alarm output K17 may be connected to, for example, a bell device.

The latching input or strobe to the Octal "D" flip-flop network U1 is connected to output pin 7 of binary coder U19 (FIG. 10).

Figure 11:
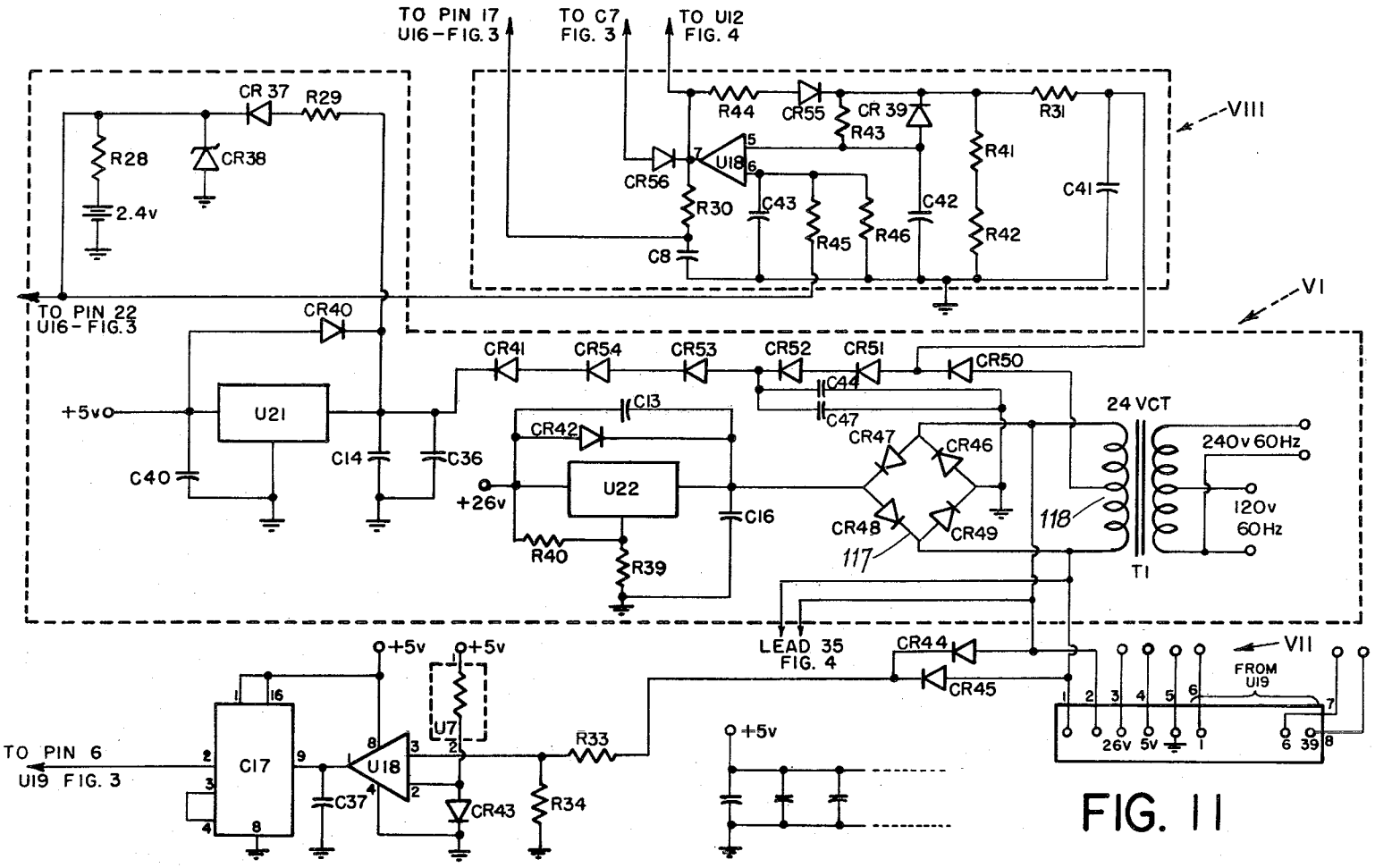
FIG. 11 is a circuit diagram of the power supply, the power sensing circuitry and the line frequency monitor unit.

A clear input (pin 1) of the flip-flop network U1 is connected to the output of inverter U12. The clear inputs to inverter U12 and flip-flop networks U3 and U5 are connected, via a release delay RC network R38, C38, to the power sensing circuit VIII (FIG. 11).

With reference to FIG. 10, the mode selector switch S1, advance switch S2, and the enter switch S3 will now be described. The mode selector switch S1 basically comprises a 6 position rotary switch, with each terminal position being connected to an output of the binary coder or multiplexer U9. The wiper terminal 40 of switch S1 is connected to one input of a three input NOR gate U12. The second input of NOR gate U12 is connected in series with the advance switch S2 to an output of the binary coder U9. The third input of NOR gate U12 is connected in series with the enter switch S3 to another output of the binary coder U9. NOR gate U12 may comprise any conventional NOR gate circuit such as a 4025B from RCA. NOR gate U12 has its inputs weekly biased low by three resistors R25–27 connected between ground and each input. The mode selector switch S1, the advanced switch S2 and the enter switch S3 are selectively identified by the sequential strobing of each respective output of multiplexer U9. The output of NOR gate U12 is connected to microprocessor U19 for correlating the switch and associated strobe to recognize/identify each switch's S1, S2, and S3 physical position.

With reference to FIG. 8, the termination monitor section IV bascially consists of a terminal network having sixteen individual terminals T1–T16 and a terminal common. Each terminal T1–T16 and the terminal common is coupled to a respective refrigerator unit. The other end of each terminal T1–T16 is connected via a respective resistor to an output of multiplexer U11. The 16 discrete termination resistors are contained in resistor network U14 and U15, each of which contains eight such termination resistors. The termination resistors serve as a mild signal attenuator for the respective input T1–T16. The remote ends of each of the termination resistors from their respective terminal T1–T16 end connections, are connected to a capacitor C20–C35, respectively, which provides high frequency filtering for the input signals. Each remote end of the termination resistors are also biased high by connection to, for example, a 5 VDC potential via a respective (6.8 K ohm) biasing resistor. The biasing resistors are contained in resistor networks U13 and U23, each of which contains eight separate such resistors. The common junction between each remote end of a termination resistor, a biasing resistor and a respective capacitor C20–C35 is connected to one of the 16 inputs of multiplexer U11.

The multiplexer U11 via data bus 99 is coupled to strobing information from microprocessor U19. This information enables the multiplexer U11 to select the monitored (data) input signals on terminals T1–T16 for being multiplexed and transmitted to microprocessor U19. The microprocessor U19, in turn, processes this multiplexed information for executing the termination functions.

The data memory section V basically comprises a 1024 bit static CMOS RAM U16 with a 256×4 bit arrangement, such as a MWS5101 circuit chip by RCA. The RAM U16 provides the necessary memory capacity to retain the information required by the timer 90. This information includes the user's defrost schedule program, each output programmed duration, the programmed time references, each activated output's remaining defrost time and all other similarly pertinent information. The eight address input lines 40 are connected/sourced by a respective output of an Octal "D" flip-flop network U15, such as a 74C374A by National Semiconductor. The output of the discrete flip-flops are used to latch a respective ones of the eight address input signals, via lead 114, which are momentarily presented on the latch input of the flip-flop network U15. The address designator signals are validated by a strobe signal from microprocessor U19 via NOR gate 116. NOR gate 116 may be a 4025 circuit chip from RCA. NOR gate 116 provides the necessary inversion of the strobe signals to latch the appropriate information in the flip-flop network U15.

The address signals presented on lead 115 in conjunction with strobe signals from microprocessor U19 (pins 8 and 10), are coupled to RAM U16 to control the direction of data transfer. A strobe signal on pin 8 will cause data transfer from RAM U16 to microprocessor U19. Conversely, if a strobe signal is provided on pin 10, data transfer is enabled from microprocessor U19 to RAM U16.

The memory clear (pushbutton) switch S4, as noted above, is connected to RAM U16 and to the power sensing circuit for providing a user memory clear function. This is effected by shorting to ground the RAM U16 and providing a false power loss indication to the power sensing circuit VIII which energizes the alarm indicator 95.

With reference to FIG. 11, the power supply VI, line frequency monitor VII, and power sensing unit VIII will now be described.

For ease of understanding the power supply can be understood as comprising three separate supplies; (1) a 26 VDC supply used for powering the output signals/-relay coils, (2) the battery supported RAM supply and (3) the 5 VDC logic supply used for the balance of the circuitry.

The 26 VDC supply is provided by, for example, an LM317 by National Semiconductor, which is designated a U22. This device is an adjustable (1.2 V–37 V) positive voltage regulator. Adjustment of the regulator, so as to fix the output voltage at 26 VDC, is accomplished by the program resistor R40 and the output set resistor R39 connected to the adjustment input of the regulator (pin 1). Acting as the source supply to the regulator is a full-wave bridge rectifier 117 connect to the 24 VAC transformer secondary 118. The bridge rectifier 117 is made up of four diodes CR46–CR49, such as IN4003 type diodes. The ridge rectifier 117 output has one side referenced to circuit ground and the other providing the pulsed CD voltage for the 26 VDC supply. This output if filtered by a capacitor C16 to reduce the ripple level of the supply line to the regulator.

The five VDC logic supply is provided by a 7805 circuit chip U21 from National Semiconductor. This device U21 is a fixed positive 5 volt regulator. Immediately connected to is output (pin 3) is a bypass capacitor C40 for improved transient response. The regulator is sourced by way of a chain of 6 diodes CR40, CR41, CR50–CR54, whose ultimate source is the center tap of the 24 VAC transformer secondary 118. The purpose of this diode chain is to provide a partial voltage drop in the line supplying the regulator so the regulator will not be subjected to as great an input-output differential voltage and as a result not have to dissipate quite as much power in regulating its output to 5 VDC. Midway down this diode chain is a capcitor pair C44 and C47. These capacitors serve as supply line filter and storage devices allowing for a delay in the loss of supply when power is removed from the unit. An additional capacitor C14 is located at the end of the diode chain to provide additional filtering and storage. Capacitor C36 is provided for input stabilizing.

Both the 26 VDC and the 5 VDC regulators have a diode CR42 and CR40, respectively, placed across their output and input terminals. These feedback diodes, which are normally reverse-biased, are provided in each case so as not to allow the input to the regulator to drop more than one diode drop (approximately 0.7 volts) below the output. This is to protect the regulators series-pass transistor (internal) from damage.

The RAM supply has its input commoned to the input of the 5 VDC regulator. This line is first presented a current limiting resistor R29. In line with this resistor R29 is an isolating diode CR37. This diode is provided so that, when power is removed from the unit, the battery in this portion of the circuit is not drained trying to supply more than it is regulated for. At the cathode end of this isolating diode is connected a Zener diode CR38. This diode CR38 is used so as not to allow the voltage, from this point on, to exceed 5.1 volts. Also connected at this point is the auxiliary battery supply with consists of a 2.4 volt battery in series with a current limiting resistor R28. Resistor's R28 primary function is to limit the charging current to the battery when the unit is under power. The output of this supply goes to the power sensing circuit VIII and the data memory circuit V.

The line frequency monitor VII provides the timer 90 with the time reference signal on display 94 by monitoring the incoming AC line frequency. A voltage comparator U18 such as an LM358 by National Semiconductor provides the logic level output indicating the amplitude relationship between the referenced input (pin 2) and the monitoring input (pin 3). The reference input is biased to approximately 0.7 volts (the forward voltage drop across diode CR43) by a resistor. The monitoring input has supplied to it a full-wave rectified pulsated DC signal at twice the line frequency. This is done by means of the diode pair CR44 and CR45, in conjunction with bridge diodes CR46 and CR49. The voltage level of this signal is reduced by means of the voltage divider arrangement of R33 and R34. The resulting output of the comparator U18 is a logic level pulse train with a frequency double that of the supply line. A high frequency filter C37 is connected to this output prior to its input to a flip-flop netwrok U17 so arranged as to halve the frequency and output a square wave equal to the line frequency. This signal is then fed to pin 6 of microprocessor U19 and lead 78 (FIG. 4) as a 60 Hz fixed frequency timing reference.

The power sensing circuit VIII detects whether the incoming supply potential is sufficient for providing stable power supply output and terminates the operation of the timer 90 when incoming potentials drop below a predetermined level.

The power sensing circuit VIII basically comprises a voltage comparator U18 with hysteresis such as an LM 358 by National Semiconductor. The reference voltage on pin 6 of comparator U18 results from a voltage divider network R45 and R46 which is high frequency filtered by capacitor C43 and sourced from the RAM supply to provide a continuous positive reference. The monitoring input centers on an RC network R43 and R42 with a shunting diode CR39 paralleling the resistor in the discharge path. The primary source to this RC network comes from the transformer center tap. This signal is noise filtered via capacitor C41 and voltage reduced via voltage divider arrangement of resistors R31, R41 and R42. The resulting signal being supplied to the RC network is a DC voltage level with an AC ripple voltage at twice the line frequency superimposed upon it.

Positive feedback from the comparator U18 acts as a supplemental source to this RC network, when and only if the comparator U18 has been turned on. This additional feedback is to: (1) compensate for any minute (residual) ripple remaining in the RC input so as to prevent oscillation of the comparator U18 and, (2) provide a desired hysteresis so that once adequate potential is detected the unit will withstand minor fluctuations or brown-outs without shut-downs. This positive feedback is provided by resistor R44 and capacitor CR55. The values of all devices in this circuit are so chosen to mandate the comparator to turn on at 85% rated input line voltage and to provide the hysteresis, once turned on to 77% before shut-down will occur.

The output of the power sensing circuit VIII is connected to the microprocessor's U19 reset input, the RAM disable input and the clear inputs of the output latch network.

In one embodiment of the timer 90 (FIG. 9), the output defrost control signals from outputs K1–K16 are each connected to one end of a coil of a relay R1–R16, respectively. The other end of the relay coils R1–R16 are connected to the coil common terminal. In this manner, a relay circuit path is selectively coupled to the defrost control element of the respective refrigeration units for controlling the defrost cycle thereof.

I claim:

1. Apparatus for controlling defrost means in at least one refrigeration unit, comprising;

means for effecting actuation of the defrost means at a defrost initate time;

means responsive to a determined absolute humidity parameter for controlling the defrost initate time; and said means responsive to the absolute humidity including a temperature sensor for measuring an ambient temperature and for providing a first signal indicative of the measured temperature, and having a relative humidity sensor for measuring a relative humidity condition and for providing a second signal indicative of the measured relative humidity, and having a signal processing means responsive to said first and second signals for deriving a third signal having a frequency which varies in proportion with change in the absolute humidity.

2. Apparatus for controlling defrost means in at least one refrigeration unit, comprising:

means for effecting actuation of the defrost means at a defrost time and including a programmable timer for selectively scheduling the defrost initiate time;

the timer including a microprocessor responsive to the frequency of a clock signal for controlling the defrost timing by the timer;

means responsive to a determined absolute humidity parameter for controlling the defrost initiate time, and including means for providing said clock signal to said timer and for effecting a variation in the frequency of the clock signal with a variation in the determined absolute humidity; and the clock signal means providing a clock signal having a first fixed frequency corresponding to a first predetermined temperature and/or relative humidity levels, and having a second fixed frequency corresponding to a second predetermined temperature and/or relative humidity levels, and having a third frequency spectrum corresponding to a predetermined range of absolute humidity conditions.

3. Apparatus as in claim 2, wherein:

the means responsive to the absolute humidity includes a temperature sensor for measuring an ambient temperature and for providing a first signal indicative of the measured temperature, and having a relative humidity sensor for measuring a relative humidity condition and for providing a second signal indicative of the measured relative humidity, and having a signal processing means responsive to said first and second signals for deriving a third signal having a frequency which varies in proportion with change in the absolute humidity.

4. Apparatus for controlling defrost initiation of a refrigeration unit having refrigeration and defrost means, comprising:

temperature sensor means for providing a first signal indicative of the temperature ambient to said unit;

relative humidity sensor means for providing a second signal indicative of the relative humidity ambient to said unit;

first analog-to-digital circuit means for digitizing said first signal;

second analog-to-digital circuit means for digitizing said second signal;

third circuit means responsive to the digitized first signal to provide a third signal substantially indicative of the saturation humidity of a unit of air at the temperature represented by the digitized first signal;

signal generating means responsive to the digitized second signal to provide a fourth signal having a frequency which varies as a function of the relative humidity;

fourth circuit means responsive to said third and fourth signals for providing a fifth signal having a frequency which varies as a function of the third and fourth signals; and timer means providing a defrost initiate signal to effect defrost initiation of the refrigeration unit at periodic intervals, said timer means varying said periodic intervals as a function of the frequency of said fifth signal.

5. Apparatus as in claim 4, wherein:

the third circuit means comprises a digital scaling circuit for linear scaling of said digitized first signal according to a predetermined correspondence between temperature and saturation humidity for a unit of air.

6. Apparatus as in claims 4 or 5, wherein:

the signal generating means comprises an oscillator having a predetermined base frequency which is varied according to a predetermined code of the digitized second signal as a function of the relative humidity.

7. Apparatus as in claim 6, wherein:

the fourth circuit means includes a programmable divide-by "N" circuit having a first input responsive to said fourth signal, and a program control input responsive to said third signal, said third signal being representative of "N" which is variable in proportion with changes in a saturation humidity evaluation.

8. Apparatus as in claim 7, including:

a low limit circuit means responsive to a first predetermined signal code of said digitized first and second signals to provide a first fixed frequency signal;

a high limit circuit means responsive to a second predetermined signal code of said digitized first and second signals to provide a second fixed frequency signal; and switch means responsive to said first and second coded signals for selectively disconnecting said fifth signal input to said timer means and coupling either said first or second fixed frequency signal to the input of said timer.

9. Apparatus as in claim 4, wherein:

the fourth circuit means includes a programmable divide-by "N" circuit having a first input responsive to said fourth signal, and a program control input responsive to said third signal, said third signal being representative of "N" which is variable in proportion with changes in a saturation humidity condition evaluation.

10. Apparatus as in claim 9, including:

a low limit circuit means responsive to a first predetermined signal code of said digitized first and second signals to provide a first fixed frequency signal;

a high limit circuit means responsive to a second predetermined signal code of said digitized first and second signals to provide a second frequency signal; and switch means responsive to said first and second coded signals for selectively disconnecting said fifth signal input to said timer means and coupling either said first or second fixed frequency signal to the input of said timer.

11. Apparatus as in claim 4, including a low limit circuit means responsive to a first predetermined signal code of said digitized first and second signals to provide a first fixed frequency signal;

a high limit circuit means responsive to a second predetermined signal code of said digitized first and second signals to provide a second fixed frequency signal; and switch means responsive to said first and second coded signals for selectively disconnecting said fifth signal input to said timer means and coupling either said first or second fixed frequency signal to the input of said timer.

12. Apparatus for controlling defrost means in at least one refrigeration unit, comprising:

means for effecting actuation of the defrost means at a defrost time and including a programmable timer for selectively scheduling the defrost initiate time;

the timer including a microprocessor responsive to the frequency of a clock signal for controlling the defrost timing by the timer;

means responsive to a determined absolute humidity parameter for controlling the defrost initiate time, and including means for providing said clock signal to said timer and for effecting a variation in the frequency of the clock signal with a variation in the determined absolute humidity; and the means responsive to the absolute humidity including a temperature sensor for measuring an ambient temperature and for providing a first signal indicative of the measured temperature, and having a relative humidity sensor for measuring a relative humidity condition and for providing a second signal indicative of the measured relative humidity, and having a signal processing means responsive to said first and second signals for deriving a third signal having a frequency which varies in proportion with change in the absolute humidity.

* * * * *